US005221042A

United States Patent [19]

Oliff

[11] Patent Number: 5,221,042

[45] Date of Patent: Jun. 22, 1993

[54] CARTON CARRYING HANDLE

[75] Inventor: James R. Oliff, Austell, Ga.

[73] Assignee: The Mead Corporation, Dayton, Ohio

[21] Appl. No.: 971,931

[22] Filed: Nov. 5, 1992

[51] Int. Cl.[5] ..... B65D 5/46

[52] U.S. Cl. ..... 229/117.13; 206/427

[58] Field of Search ..... 229/117.13, 40; 206/141, 427

[56] References Cited

U.S. PATENT DOCUMENTS

| | | | |
|---|---|---|---|
| 2,681,143 | 6/1954 | Guyer | 229/117.13 |
| 2,797,856 | 7/1957 | Jaeschke | 229/117.13 |
| 3,933,303 | 1/1976 | Kirby, Jr. | 229/117.13 |
| 4,121,757 | 10/1978 | Hamlin | 229/117.13 |
| 4,331,289 | 5/1982 | Killy | 229/117.13 |
| 4,538,759 | 9/1985 | Dutcher | 229/117.13 |
| 4,577,799 | 3/1986 | Oliff | 229/117.13 |
| 4,679,725 | 7/1987 | Wilson | 229/117.13 |
| 4,712,728 | 12/1987 | Schuster | 229/117.13 |
| 5,119,985 | 6/1992 | Dawson et al. | 229/117.13 |

FOREIGN PATENT DOCUMENTS

| | | | |
|---|---|---|---|
| 877792 | 8/1971 | Canada | 229/117.13 |
| 2274509 | 1/1976 | France | 229/117.13 |

*Primary Examiner*—Gary E. Elkins
*Attorney, Agent, or Firm*—Rodgers & Rodgers

[57] ABSTRACT

A carton carrying handle in a composite top wall of a carton having interconnected side and bottom walls arranged with the composite wall to form a tubular structure and having end closure panels. The composite top wall includes a pair of top panels foldably joined respectively to the side walls and having inner and outer overlapping longitudinal strips arranged to form a glue lap. A single hand gripping aperture is formed in the outer one of the top panels adjacent the glue lap.

2 Claims, 3 Drawing Sheets

CARTON CARRYING HANDLE

TECHNICAL FIELD

This invention relates to a carrying handle for a carton arranged to package a plurality of articles.

BACKGROUND ART

U.S. Pat. No. 2,681,143 issued Jun. 15, 1954 discloses a carton having a top wall foldably joined along arcuate fold lines to opposed side walls.

U.S. Pat. No. 3,955,748 issued May 11, 1976 and owned by the assignee of this invention discloses an article carrier having a pair of hand gripping apertures formed in one wall of the carton.

U.S. Pat. No. 4,577,799 issued Mar. 25, 1986 and owned by the assignee of this invention discloses a carton having a pair of hand gripping apertures formed in one wall of the carton.

SUMMARY OF THE INVENTION

According to this invention in one form, a carrying handle is formed in a composite top wall of a carton having a pair of lap panels and includes a single hand gripping aperture formed in the outer one of the top panels and arranged so that an overlapping glue lap formed in a pair of top panels which constitute the composite top wall is adjacent to the single hand gripping aperture thereby to enhance the mechanical strength of the structure. The top wall is joined to the top edges of opposed side walls along straight fold lines and includes downwardly bevelled end portions.

BEST MODE OF CARRYING OUT THE INVENTION

Figure 1:
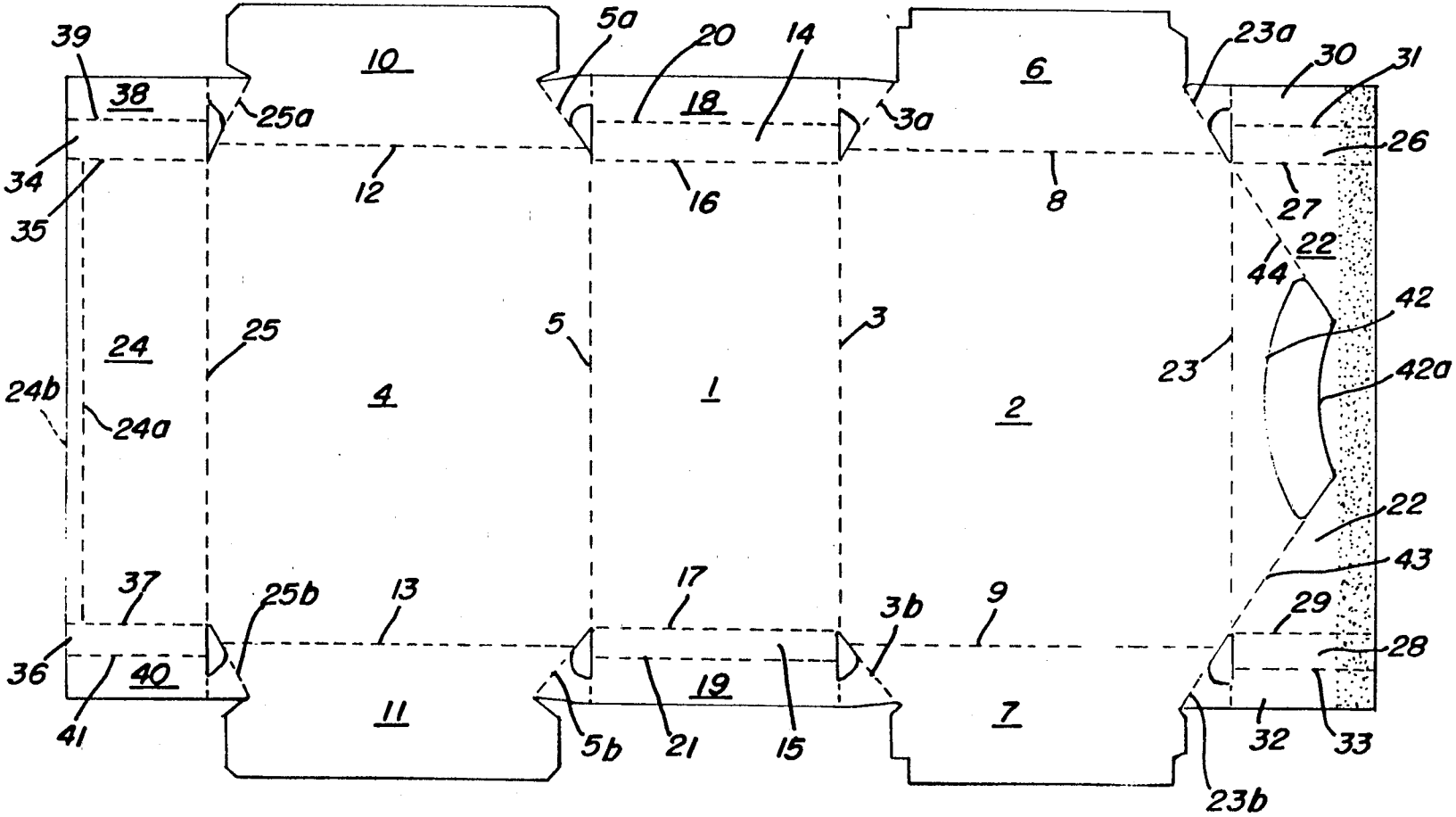
FIG. 1 is a plan view of a blank as viewed from the inside thereof and which is formed according to this invention.

In the drawings the numeral 1 designates the bottom wall of the carton. Side wall 2 is foldably joined to bottom wall 1 along fold line 3 and side wall 4 is foldably joined to bottom wall 1 along fold line 5. End wall panels 6 and 7 are respectively joined to side wall 2 along fold lines 8 and 9. Fold line 3 is extended as indicated at 3*a* and 3*b* to facilitate formation of the corners at the ends of end panels 6 and 7. Similarly end wall panels 10 and 11 are foldably joined respectively to side wall 4 along fold lines 12 and 13. Fold line 5 is extended as indicated at 5*b* to aid in properly manipulating corners at the adjacent ends of end panels 10 and 11 as is well known.

Bevelled panels 14 and 15 are joined respectively to bottom wall 1 along fold lines 16 and 17. End closure flaps 18 and 19 are foldably joined to bevelled panels 14 and 15 respectively along fold lines 20 and 21.

Top lap panel 22 is foldably joined to side wall 2 along fold line 23 while top lap panel 24 is foldably joined to the side wall 4 along fold line 25. Fold line 23 is extended as indicated at 23*a* and 23*b* to facilitate formation of corners at the ends of end panels 6 and 7. Similarly fold line 25 is extended as indicated at 25*a* and 25*b* to facilitate formation of carton corners at the adjacent ends of end panels 10 and 11.

Bevelled panel 26 is foldably joined to top lap panel 22 along fold line 27 while bevelled panel 28 is foldably joined to top panel 22 along fold line 29. End flap 30 is foldably joined to bevelled panel 26 along fold line 31 while end flap 32 is foldably joined to bevelled panel 28 along fold line 33.

At the other end of the carrier bevelled panel 34 is foldably joined to top lap panel 24 along fold line 35 while bevelled panel 36 is foldably joined along fold line 37 to top lap panel 24. End flap 38 is foldably joined to bevelled panel 34 along fold line 39 while end flap 40 is foldably joined to bevelled panel 36 along fold line 41.

Hand carrying aperture 42 is formed in top lap panel 22 and is of general arcuate configuration.

Yieldable lines such as are designated by the numerals 43 and 44 are formed in top panel 22 and function in known manner to distribute the stress throughout the panel 22 thereby to minimize the likelihood of tearing the panel. Yieldable lines 43 and 44 each extend from a corner formed by top panel 22 and the adjacent side wall 2 to the peripheral edge of hand carrying aperture 42. If desired yieldable lines could be formed in inner top panel 24 but are not deemed to be necessary.

In order to form a carrier from the blank shown in FIG. 1, top lap panel 24 is elevated and folded to the right along fold line 25. An application of glue is made to panel 22 as shown by stippling 22*a*. Thereafter side wall 2 and lap panel 22 are elevated and folded to the left along fold line 3 so as to bring panel 22 into contact with panel 24. This operation causes the blank of FIG. 1 to occupy a collapsed position.

Figure 2:
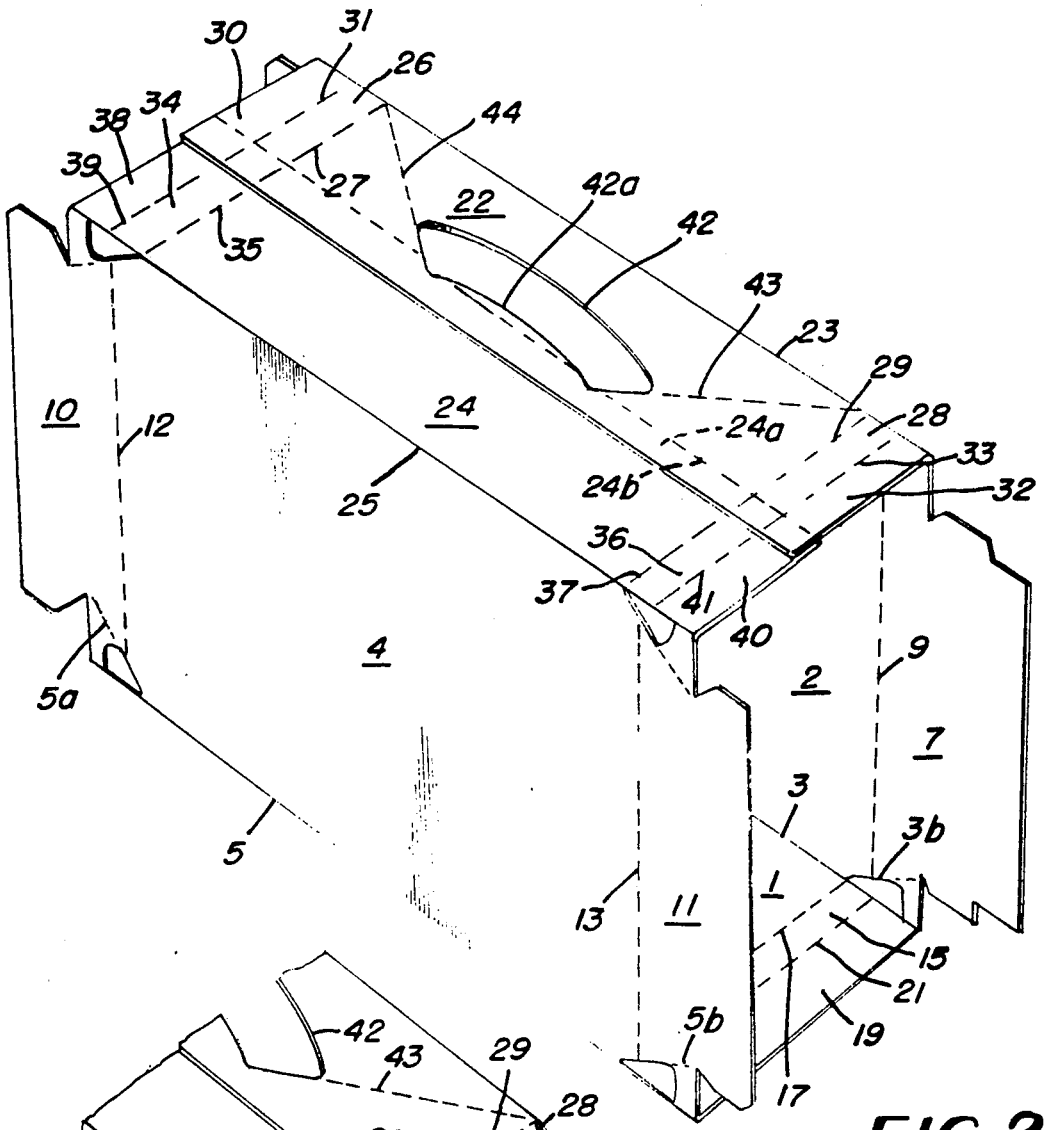
FIG. 2 is a perspective view of an open ended tubular structure formed from the blank of FIG. 1 and which shows the carton in a condition for acceptance of items to be loaded into the carton.

The collapsed carton may be manipulated into set up condition as shown in FIG. 2. When so arranged with the ends of the tubular structure open as indicated in FIG. 2, the carton may be loaded from one or both ends as is well known. Ordinarily articles packaged in a carton of this type are disposed with their medial axes in horizontal positions.

Figure 3:
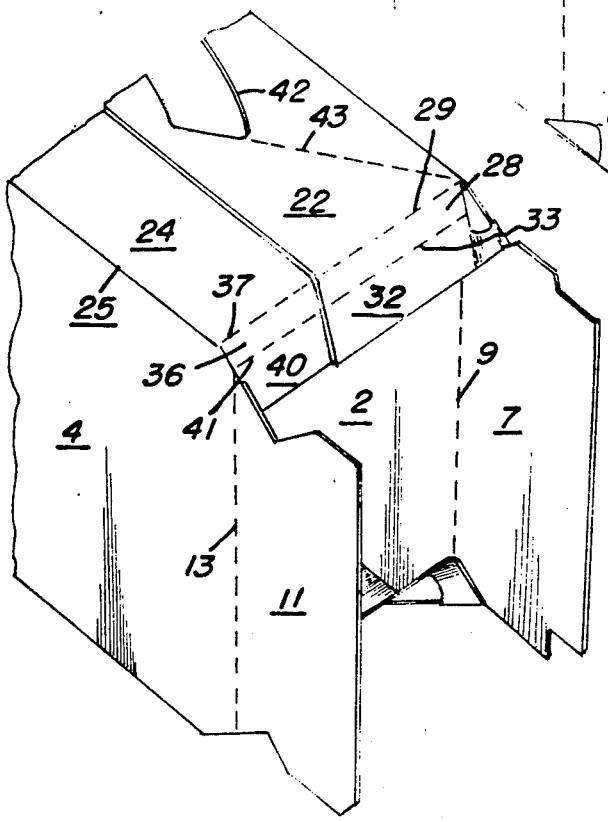
FIG. 3 shows one end of the structure shown in FIG. 2 in partially closed condition.
Figure 4:
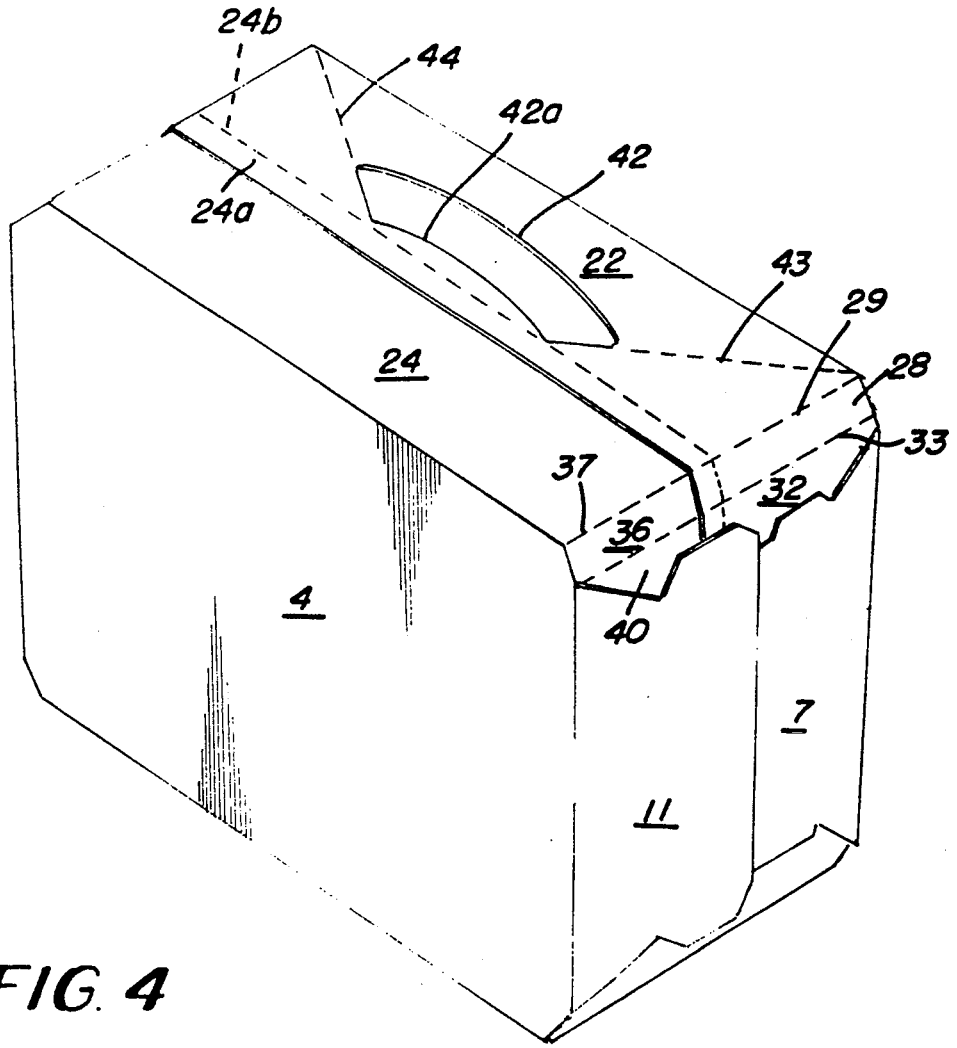
FIG. 4 shows a complete carton set up, loaded and closed in accordance with this invention.

Following loading end flaps such as 32 and 40 are folded downwardly into the positions represented in FIG. 3. Following this operation and after a similar operation at the other end of the carton involving end flaps 18 and 19, an application of glue is made in known manner to one or both of the end wall panels 7 and 11 and 6 and 10 and the completely loaded and set up carton then appears as shown in FIG. 4.

It is obvious that a single hand gripping aperture such as is indicated by the numeral 42 is required in accordance with this invention. This aperture is formed in panel 22 and end portions of this aperture are closely adjacent the edge 24*b* of longitudinal strip 24*a* which constitutes the end edge of top panel 24. Thus as is clearly indicated in FIG. 2 the longitudinal strip 24*a* constitutes a reinforcement for the handle 42 since in effect the strip 24*a* together with the adjacent face contacting end edge of panel 22 constitute a double thickness glue lap which requires only one handle aperture such as is indicated at 42.

One of the advantages of this structure is that a cushioning flap indicated at 42*a* is foldably joined to top panel 22 along a fold line indicated at 24*b* and which coincides with the adjacent end edge of top panel 24.

Thus the weight of the carrier is taken without discomfort due in part to the cushioning action of cushioning flap 42*a*.

It also is significant that yieldable lines 43 and 44 which are not novel per se but serve as a convenient means of distributing the load throughout the panel 22. Also it is apparent that the use of a single hand gripping aperture such as 42 eliminates structures shown in the prior art which utilize a pair of hand gripping apertures together with the resultant tendency to weaken the top panel of the carton.

If an aperture such as 42 is placed in panel 24, the result is a likely delamination failure of the outer ply 22 followed by a tear failure of the inner ply 24. If an aperture such as 42 is placed in outer ply 22 in accordance with this invention, the likelihood of delamination is avoided and tearing of both plys 22 and 24 is required to cause failure so that the strength of both plys 22 and 24 is utilized.

I claim:

1. A carrying handle for a carton formed from a unitary blank for packaging a plurality of cans and having a composite top wall and interconnected side and bottom walls arranged with said composite top wall to form a tubular structure having end closure panels, said composite top wall comprising inner and outer top panels foldably joined respectively to said side walls along straight fold lines and having downwardly inclined bevelled end panels and having inner and outer overlapping longitudinal strips secured together in a flat face contacting relation and forming a two ply medial glue lap, and a single band gripping aperture of arcuate configuration formed in the outer one only of said top panels and arranged with one edge of said aperture closely adjacent an inner edge of said glue lap to form a structure of double thickness.

2. A carrying handle according to claim 1 wherein said outer one of said top panels further includes a pair of yieldable fold lines, one of said yieldable fold lines extending from each corner formed by said outer one of said top panels and the one of said side walls to which said outer top panel is foldably joined and to a peripheral edge of said hand gripping aperture which is disposed in overlapping alignment with one of said yieldable fold lines.

* * * * *